US007326664B2

(12) United States Patent
Hartgrove et al.

(10) Patent No.: US 7,326,664 B2
(45) **Date of Patent: *Feb. 5, 2008**

(54) STRUCTURALLY STABLE FLAME RETARDANT BEDDING ARTICLES

(75) Inventors: Herbert Hartgrove, Angler, NC (US); Gregory Rabon, Clayton, NC (US); Russell Tindall, Clemmons, NC (US)

(73) Assignee: PolymerGroup, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/794,315

(22) Filed: Mar. 5, 2004

(65) Prior Publication Data

US 2005/0197028 A1 Sep. 8, 2005

(51) Int. Cl.
*D04H 1/46* (2006.01)
*D04H 1/00* (2006.01)

(52) U.S. Cl. ..... 442/414; 442/408; 442/327

(58) Field of Classification Search ..... 442/327, 442/381, 408, 414
See application file for complete search history.

(56) References Cited

U.S. PATENT DOCUMENTS

| | | | |
|---|---|---|---|
| 2,632,187 | A | 3/1953 | Wooffendale |
| 2,720,269 | A | 10/1955 | Diacos |
| 2,801,427 | A | 8/1957 | Crocker |
| 3,273,177 | A | 9/1966 | Newton |
| 3,485,706 | A | 12/1969 | Evans |
| 3,512,192 | A | 5/1970 | Simon |
| 3,670,348 | A | 6/1972 | Irwin |
| 3,818,520 | A | 6/1974 | Richards, Jr. |
| 3,818,521 | A | 6/1974 | Richards, Jr. |
| 3,857,126 | A | 12/1974 | Woodruff |
| 3,889,305 | A | 6/1975 | Goldberg |
| 3,934,285 | A | 1/1976 | May |
| 3,958,286 | A | 5/1976 | Rodinsky |
| 3,973,066 | A | 8/1976 | Smith, II et al. |
| 4,070,217 | A | 1/1978 | Smith, II et al. |
| 4,092,752 | A | 6/1978 | Dougan |
| 4,316,298 | A | 2/1982 | Russo et al. |
| 4,326,310 | A | 4/1982 | Frankenberg |
| 4,430,765 | A | 2/1984 | Karpen |
| 4,443,903 | A | 4/1984 | Leitner |
| 4,504,991 | A | 3/1985 | Klancnik |
| 4,690,859 | A | 9/1987 | Porter et al. |

(Continued)

FOREIGN PATENT DOCUMENTS

EP 0 940 487 A3 1/2000

(Continued)

OTHER PUBLICATIONS

Assembly Bill 603, Aug. 12, 2001.

(Continued)

*Primary Examiner*—Lynda Salvatore
(74) *Attorney, Agent, or Firm*—Kilyk & Bowersox, PLLC; Valerie Calloway

(57) ABSTRACT

A flame retardant bedding article comprises a hydroentangled flame retardant nonwoven component, and more specifically, a bedding article such as a mattress, pillow cover or mattress pad, comprising a structurally stable, flame retardant nonwoven component. The component comprises at least two layers that have a synergistic relationship so as to maintain the structural integrity of the bedding article upon burning.

6 Claims, 1 Drawing Sheet

U.S. PATENT DOCUMENTS

| | | | | |
|---|---|---|---|---|
| 4,801,493 | A | 1/1989 | Ferziger et al. | |
| 4,866,799 | A | 9/1989 | Glackin | |
| 4,996,009 | A | 2/1991 | Hasegawa | |
| 5,098,764 | A | 3/1992 | Drelich et al. | |
| 5,236,769 | A | 8/1993 | Paire | |
| 5,252,386 | A | 10/1993 | Hughes et al. | |
| 5,272,779 | A | 12/1993 | Payton | |
| 5,279,878 | A | 1/1994 | Föttinger et al. | |
| 5,503,915 | A | 4/1996 | Ichibori et al. | |
| 5,506,042 | A | 4/1996 | Ichibori et al. | |
| 5,645,926 | A | 7/1997 | Horrocks et al. | |
| 5,802,646 | A | 9/1998 | Stolpmann et al. | |
| 5,912,196 | A | 6/1999 | Radwanski et al. | |
| 6,098,224 | A | 8/2000 | Gladney | |
| 6,102,128 | A | 8/2000 | Bridgeman | |
| 6,115,861 | A | 9/2000 | Reeder et al. | |
| 6,153,544 | A | 11/2000 | Radwanski et al. | |
| 6,358,591 | B1 | 3/2002 | Smith | |
| 6,489,256 | B1 | 12/2002 | Kent et al. | |
| 6,596,658 | B1 * | 7/2003 | Putnam et al. | 442/384 |
| 6,626,964 | B1 * | 9/2003 | Lunsford et al. | |
| 6,627,561 | B1 | 9/2003 | Wulliman et al. | |
| 6,660,503 | B2 | 12/2003 | Kierulff | |
| 6,823,548 | B2 * | 11/2004 | Murphy et al. | 5/698 |
| 7,125,460 | B2 * | 10/2006 | Ogle et al. | 156/62.2 |
| 2002/0002764 | A1 | 1/2002 | Putnam et al. | |
| 2002/0004348 | A1 | 1/2002 | Kelly et al. | |
| 2002/0098753 | A1 | 7/2002 | Latham et al. | |
| 2002/0142686 | A1 | 10/2002 | Lapierre | |
| 2002/0151238 | A1 | 10/2002 | Hartgrove et al. | |
| 2002/0182967 | A1 | 12/2002 | Erb, Jr. et al. | |
| 2003/0082972 | A1 | 5/2003 | Monfalcone, III et al. | |
| 2003/0171055 | A1 | 9/2003 | Endo et al. | |
| 2004/0132368 | A1 | 7/2004 | Price et al. | |
| 2004/0248494 | A1 | 12/2004 | Hartgrove et al. | |
| 2005/0118919 | A1 * | 6/2005 | Link et al. | 442/414 |
| 2005/0215158 | A1 | 9/2005 | Hartgrove et al. | |

FOREIGN PATENT DOCUMENTS

| | | | |
|---|---|---|---|
| EP | 0 803 040 | B1 | 9/2001 |
| JP | 2001287301 | A | 4/2000 |
| JP | 2002-262964 | A | 3/2001 |
| WO | WO 99/56588 | | 5/1999 |
| WO | WO 03/023108 | A1 | 3/2003 |
| WO | WO 03/078720 | A2 | 9/2003 |

OTHER PUBLICATIONS

Woodings, Calvin, Regenerated Cellulose Fibers, 2001, Woodhead Publishing, pp. 62-63.

Lenzing AG, "FR®-Fiberstory—The Heat Protection Fiber", 8 pages, undated, a printout of: http://www.lenzing.com/fibers/en/textiles/print/4166.jsp, Jun. 27, 2007.

Lenzing AG, "TENCEL®", 2 pages, undated, a printout of: http://www.lenzing.com/fibers/en/textiles/print/303.jsp, Jun. 27, 2007.

Lotus Organics, "Lyocell/Tencel: Facts behind the Fiber", 5 pages, 2005 (no month), a printout of: http://www.lotusorganics.com/articles/lyocell.aspx, Jun. 27, 2007.

* cited by examiner

STRUCTURALLY STABLE FLAME RETARDANT BEDDING ARTICLES

TECHNICAL FIELD

The present invention generally relates to flame retardant bedding articles comprising a hydroentangled flame retardant nonwoven component, and more specifically, to bedding articles, including mattresses, pillow covers and mattress pads, comprising a structurally stable, flame retardant nonwoven component, wherein said component comprises at least two layers that have a synergistic relationship so as to maintain the structural integrity of the bedding article upon burning.

BACKGROUND OF THE INVENTION

More than thirty years ago, flammability standards were instituted by the Consumer Product Safety Commission under 16 C.F.R. § 1632. These standards addressed the flammability requirements of mattresses to resist ignition upon exposure to smoldering cigarettes. However, the Code of Federal Regulations failed to address the need for mattresses to resist ignition upon exposure to small open flames, such as produced by matches, lighters, and candles.

Technological advances have proven to provide mattresses, as well as bedding constituents, with significantly better flammability protection. In light of these advancements, California Legislature has mandated that the Consumer Product Safety Commission establish a revised set of standards that will ensure mattresses and bedding pass an open flame ignition test. Known as Assembly Bill 603 (AB 603), California Legislature has further mandated that the revised set of standards go into affect Jan. 1st of 2004.

Flame retardant staple fiber is known in the art. Further, flame retardant fiber has been utilized in the fabrication of nonwoven fabrics for bedding applications. Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared, particularly in terms of surface abrasion, pilling and durability in multiple-use applications. Hydroentangled fabrics have been developed with improved properties which are a result of the entanglement of the fibers or filaments in the fabric providing improved fabric integrity. Subsequent to entanglement, fabric durability can be further enhanced by the application of binder compositions and/or by thermal stabilization of the entangled fibrous matrix.

U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as an aesthetically pleasing appearance.

Heretofore, nonwoven fabrics have been advantageously employed for manufacture of flame retardant fabrics, as described in U.S. Pat. No. 6,489,256, to Kent, et al., which is hereby incorporated by reference. Typically, nonwoven fabrics employed for this type of application have been entangled and integrated by needle-punching, sometimes referred to as needle-felting, which entails insertion and withdrawal of barbed needles through a fibrous web structure. While this type of processing acts to integrate the fibrous structure and lend integrity thereto, the barbed needles inevitably shear large numbers of the constituent fibers, and undesirably create perforations in the fibrous structure. Needle-punching can also be detrimental to the strength of the resultant fabric, requiring that a fabric have a relatively high basis weight in order to exhibit sufficient strength.

A need exists for a more cost effective flame retardant bedding comprising nonwoven component that is cost effective, structurally stable, soft, yet durable and suitable for various end-use applications including, but not limited to bedding components, such as mattresses, mattress pads, mattress ticking, comforters, bedspreads, quilts, coverlets, duvets, pillow covers, as well as other home uses, protective apparel applications, upholstery, and industrial end-use applications.

SUMMARY OF THE INVENTION

The present invention is directed to flame retardant bedding articles comprising a hydroentangled flame retardant nonwoven component, and more specifically, to bedding articles comprising a structurally stable, flame retardant nonwoven component, wherein said component comprises at least two layers that have a synergistic relationship so as to maintain the structural integrity of the bedding article upon burning.

In accordance with the present invention, the bedding comprised of nonwoven component comprises at least a first and second layer. The first layer comprises a blend of lyocell fiber and modacrylic fiber. The fibrous blend of the first layer provides the layered nonwoven component with exceptional strength, in addition to a soft hand. Further, the modacrylic fiber is self-extinguishing and known to char rather than melt when burned.

Adjacent the first layer is a second layer, comprising a blend of lyocell fiber, modacrylic fiber, and para-aramid fiber. Incorporating one or more para-aramid fibers maintains the fibrous structural integrity of the fabric, as well as reduces any thermal shrinkage. The composite of fibers utilized within the flame retardant layered fabric has a synergistic relationship to provide a cost effective fabric with exceptional strength, softness, and flame retardancy, wherein upon burning, the fabric chars, yet retains its structural integrity due to the incorporation of para-aramid fiber.

The layered structure of the flame retardant nonwoven bedding article component lends to the aesthetic quality of the bedding. Para-aramid fiber typically adds to the discoloration of the fabric, imparting an undesirable yellow hue. However, the lack of para-aramid fiber in the first layer, which is positioned atop the second layer, masks the discoloration of the second layer. Optionally, the construct may comprise three or more layers, wherein the additional layers may be chosen from nonwovens, wovens, and/or support layers, such as scrims.

The first and second layers of the flame retardant nonwoven bedding component are juxtapositioned and subsequently hydroentangled to form a structurally stable composite fabric. In addition, the nonwoven fabric may be hydroentangled on a foraminous surface, including, but not limited to a three-dimensional image transfer device, embossed screen, three-dimensionally surfaced belt, or perforated drum, suitably further enhancing the aesthetic quality of the fabric for a particular end-use application.

Other features and advantages of the present invention will become readily apparent from the following detailed description, the accompanying drawings, and the appended claims.

DETAILED DESCRIPTION

Figure 1:
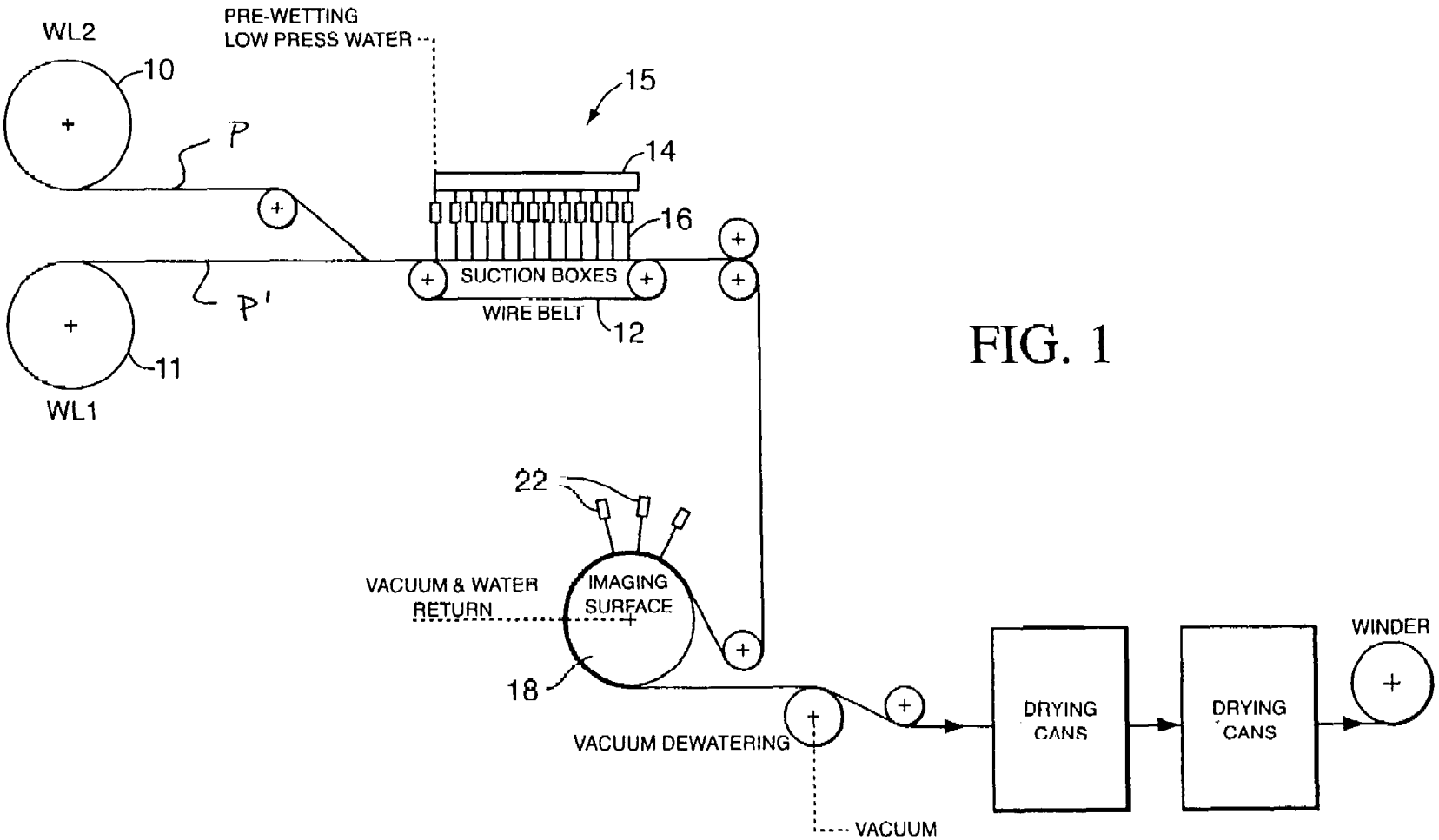
FIG. 1 is a diagrammatic view of apparatus utilized in accordance with the present invention so as to manufacture the flame retardant nonwoven fabric.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

The structurally stable, flame retardant, bedding component of the present invention, which is comprised of nonwoven layered fabric is cost effective, structurally stable, soft, yet durable and suitable for various end-use applications including, bedding articles, such as mattresses, mattress pads, mattress ticking, comforters, bedspreads, quilts, coverlets, duvets, pillow covers, as well as other home uses, protective apparel applications, upholstery, and industrial end-use applications.

U.S. Pat. No. 3,485,706, to Evans, hereby incorporated by reference, discloses processes for effecting hydroentanglement of nonwoven fabrics. With reference to FIG. 1, therein is illustrated an apparatus for practicing the present method for forming a structurally stable, flame retardant nonwoven bedding component. The lyocell and modacrylic fibrous components are preferably carded and cross-lapped to form first precursor web, designated P, which is consolidated by hydraulically energy to form a nonwoven layered fabric.

In accordance with the present invention, a second precursor web may be formed, designated P', wherein the second precursor web comprises a blend of lyocell, modacrylic, and para-aramid fibrous components. Subsequently, the second precursor web is placed in juxtaposition to the first precursor web where they are united by hydroentanglement. Optionally, the adjoined first and second precursor webs are further entangled on a foraminous surface, including, but not limited to a three-dimensional image transfer device, embossed screen, three-dimensionally surfaced belt, or perforated drum, suitably further enhancing the aesthetic quality of the fabric for a particular end-use application.

It is in the purview of the present invention, that additional flame retardant fibers be incorporated in either one or both of the precursor webs, these fibers include, but are not limited to melamine fibers, phenolic fibers, such as Kynol™ fiber from American Kynol, Inc., pre-oxidized polyacrylonitrile fibers, such as Panox® fiber, a registered trademark to R.K. Textiles Composite Fibres Limited.

FIG. 1 illustrates a hydroentangling apparatus, whereby the apparatus includes a foraminous forming surface in the form of belt 12 upon which the precursor webs P and P' are positioned for entangling or pre-entangling by manifold 14.

The entangling apparatus of FIG. 1 may optionally include an imaging and patterning drum 18 comprising a three-dimensional image transfer device for effecting imaging and patterning of the lightly entangled precursor web. The image transfer device includes a moveable imaging surface which moves relative to a plurality of entangling manifolds 22 which act in cooperation with three-dimensional elements defined by the imaging surface of the image transfer device to effect imaging and patterning of the fabric being formed.

In addition to the first and second layers of the flame retardant nonwoven fabric, it is also contemplated that one or more supplemental layers be added, wherein such layers may include a spunbond fabric. In general, the formation of continuous filament precursor webs involves the practice of the "spunbond" process. A spunbond process involves supplying a molten polymer, which is then extruded under pressure through a large number of orifices in a plate known as a spinneret or die. The resulting continuous filaments are quenched and drawn by any of a number of methods, such as slot draw systems, attenuator guns, or Godet rolls. The continuous filaments are collected as a loose web upon a moving foraminous surface, such as a wire mesh conveyor belt. When more than one spinneret is used in line for the purpose of forming a multi-layered fabric, the subsequent webs are collected upon the uppermost surface of the previously formed web. Further, the addition of a continuous filament fabric may include those fabrics formed from filaments having a nano-denier, as taught in U.S. Pat. No. 5,678,379 and No. 6,114,017, both incorporated herein by reference. Further still, the continuous filament fabric may be formed from an intermingling of conventional and nano-denier filaments.

It has been contemplated that the nonwoven fabric of the present invention incorporate a meltblown layer. The meltblown process is a related means to the spunbond process for forming a layer of a nonwoven fabric is the meltblown process. Again, a molten polymer is extruded under pressure through orifices in a spinneret or die. High velocity air impinges upon and entrains the filaments as they exit the die. The energy of this step is such that the formed filaments are greatly reduced in diameter and are fractured so that microfibers of finite length are produced. This differs from the spunbond process whereby the continuity of the filaments is preserved. The process to form either a single layer or a multiple-layer fabric is continuous, that is, the process steps are uninterrupted from extrusion of the filaments to form the first layer until the bonded web is wound into a roll. Methods for producing these types of fabrics are described in U.S. Pat. No. 4,041,203. Nanofiber fabrics may be utilized as well and are represented by U.S. Pat. Nos. 5,678,379 and 6,114,017, both incorporated herein by reference. The meltblown process, as well as the cross-sectional profile of the meltblown microfiber, is not a critical limitation to the practice of the present invention.

In accordance with the present invention, the structurally stable, hydroentangled, flame retardant, nonwoven bedding component may comprise a film layer. The formation of finite thickness films from thermoplastic polymers, suitable as a strong and durable carrier substrate layer, is a well-known practice. Thermoplastic polymer films can be formed by either dispersion of a quantity of molten polymer into a mold having the dimensions of the desired end product, known as a cast film, or by continuously forcing the molten polymer through a die, known as an extruded film. Extruded thermoplastic polymer films can either be formed such that the film is cooled then wound as a completed material, or dispensed directly onto a secondary substrate material to form a composite material having performance of both the substrate and the film layers.

Extruded films can be formed in accordance with the following representative direct extrusion film process. Blending and dosing storage comprising at least one hopper loader for thermoplastic polymer chip and, optionally, one for pelletized additive in thermoplastic carrier resin, feed into variable speed augers. The variable speed augers transfer predetermined amounts of polymer chip and additive pellet into a mixing hopper. The mixing hopper contains a mixing propeller to further the homogeneity of the mixture. Basic volumetric systems such as that described are a minimum requirement for accurately blending the additive into the thermoplastic polymer. The polymer chip and additive pellet blend feeds into a multi-zone extruder. Upon mixing and extrusion from the multi-zone extruder, the polymer compound is conveyed via heated polymer piping through a screen changer, wherein breaker plates having different screen meshes are employed to retain solid or semi-molten polymer chips and other macroscopic debris. The mixed polymer is then fed into a melt pump, and then to a combining block. The combining block allows for multiple film layers to be extruded, the film layers being of either the same composition or fed from different systems as described above. The combining block is connected to an extrusion die, which is positioned in an overhead orientation such that molten film extrusion is deposited at a nip between a nip roll and a cast roll.

In addition, breathable films can be used in conjunction with the disclosed continuous filament laminate. Monolithic films, as taught in patent number U.S. Pat. No. 6,191,211, and microporous films, as taught in patent number U.S. Pat. No. 6,264,864, both patents herein incorporated by reference, represent the mechanisms of forming such breathable films.

EXAMPLE

In accordance with the present invention, Sample A comprises a first layer of 60% staple length Tencel® lyocell fibers, Tencel® is a registered trademark of Courtaulds Fibres (Holdings) Limited, and 40% PBX® modacrylic fibers, PBX® is a registered trademark to Kaneka, with a basis weight of about 2.0 oz/yd$^2$ and a second layer comprising a blend of 42% Tencel® lyocell fibers, 37% PBX® modacrylic fibers, and 21% Twaron® para-aramid fibers, Twaron® is a registered trademark of Enka B.V. Corporation, with a basis weight of about 4.0 oz/yd$^2$. The layers were consolidated into a composite flame retardant nonwoven composite fabric by way of hydroentanglement. Subsequently, the composite fabric was advanced onto a three-dimensional image transfer device so as to impart a three-dimensional pattern into the fabric. Table 1 shows the physical test results of the aforementioned fabric. Table 2 also comprises physical test results for a flame retardant component made in accordance with the present invention.

TABLE 1

| Composition | Sample A |
|---|---|
| ITD | Tricot |
| Weight | 4.6 oz/yd$^2$ |
| Bulk | 44 mils |
| Tensile MD-Peak (ASTM D-5035) | 80 g/cm |
| Tensile CD-Peak | 48 g/cm |
| MD Elong. | 29.2% |
| CD Elong. | 94.4% |
| Elmendorf Tear-MC (ASTM D-5734) | 3178 g |
| Elmendorf Tear-CD | 2087 g |
| Air Permeability (ASTM D-737) | 147 cfm |

TABLE 1-continued

| | |
|---|---|
| Absorbency | 7 sec |
| Thermal Shrinkage, MD (FNA-LB-WI-GL-136) | −1.0 |
| Thermal Shrinkage, CD | −1.0 |
| Modified Vert. Burn | |
| BFT Flame Test | 17.1 |

TABLE 2

| Composition | | face 61% Tencel ® H215 968 1.5 dpf × 1.5"/39% PBX ® 2.0 dpf × 2" back 42% Panox ® SM C051 SSC 2 dpf × 2"/35% PBX ® 2.0 dpf × 2"/23% Tencel ® H215 968 1.5 dpf × 1.5" |
|---|---|---|
| ITD | | Tricot |
| Weight | oz/yd$^2$ | 5.5 |
| Bulk | mils, 1-ply | 55 |
| Tensile MD-Peak | lbs. | 66 |
| Tensile CD-Peak | lbs. | 44 |
| MD Elong. | % | 34 |
| CD Elong. | % | 92 |
| Elmendorf Tear-MD | grams | 2192 |
| Elmendorf Tear-CD | grams | 3515 |
| Air Permeability | cfm | 151 |
| Thermal Shrinkage, MD | % @ 140 C./ 1.5 min. | −1.0 |
| Thermal Shrinkage, CD | % @ 140 C./ 1.5 min. | 0 |
| TB 604 | % weight loss | 0.9 |

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. An article of bedding comprising a structurally stable, flame retardant nonwoven component, wherein said component comprises a first layer and a second layer, said first layer consisting of a blend of lyocell fiber and modacrylic fiber and said second layer consisting of a blend of lyocell fiber, modacrylic fiber, and para-aramid fiber, wherein said first and second layers are in a juxtaposed, hydroentangled arrangement forming said component.

2. An article of bedding comprising a structurally stable, flame retardant nonwoven component as in claim 1, wherein said component is selected from the group consisting of a comforter, quilt, bedspread, duvet, coverlet, or combination thereof.

3. An article of bedding comprising a structurally stable, flame retardant nonwoven component as in claim 1, wherein said component is a mattress.

4. An article of bedding comprising a structurally stable, flame retardant nonwoven component as in claim 1, wherein said component is a mattress pad.

5. An article of bedding comprising a structurally stable, flame retardant nonwoven component as in claim 1, wherein said component is a pillow cover.

6. An article of bedding comprising a three-dimensionally imaged, structurally stable, flame retardant, nonwoven component, wherein said component has a three-dimensional fabric pattern, and said component comprises a first layer and a second layer, said first layer consisting of a blend of lyocell fiber and modacrylic fiber and said second layer consisting of a blend of lyocell fiber, modacrylic fiber, and para-aramid fiber, wherein said first and second layers are in a juxtaposed, hydroentangled arrangement forming said component having the three-dimensional fabric pattern.

* * * * *